United States Patent [19]

Munson

[11] 4,003,309

[45] Jan. 18, 1977

[54] HAND GRIP UNIT FOR RUBBER STAMPS

[76] Inventor: Whitney K. Munson, P.O. Box 828, Red Bank, N.J. 07701

[22] Filed: Sept. 2, 1975

[21] Appl. No.: 609,653

[52] U.S. Cl. ..... 101/406; 101/368

[51] Int. Cl.[2] ..... B41K 1/56

[58] Field of Search ..... 101/327, 368, 405, 406, 101/333, 334, 371; 40/328; 29/463; 145/61 R, 64; 16/110 S, 114 R, 114 A, 122

[56] References Cited

UNITED STATES PATENTS

| | | | |
|---|---|---|---|
| 258,666 | 5/1882 | Murdock, Jr. | 101/371 |
| 446,587 | 2/1891 | Reynolds | 101/406 |
| 583,287 | 5/1897 | Gardner | 101/406 |
| 636,077 | 10/1899 | Smith | 101/406 |
| 705,377 | 7/1902 | Buchanan | 101/406 |
| 1,038,219 | 9/1912 | Smith | 101/405 X |
| 1,284,446 | 11/1918 | Potts | 101/406 |
| 1,506,985 | 9/1924 | Melind | 101/405 |
| 1,879,387 | 9/1932 | Melind | 101/405 X |
| 2,049,599 | 8/1936 | Weissman | 101/405 X |
| 2,232,410 | 2/1941 | Smith | 101/406 |
| 2,819,668 | 1/1958 | McAneny | 101/405 X |
| 3,158,094 | 11/1964 | Harris et al. | 101/327 |
| 3,302,566 | 2/1967 | Blanchet | 101/405 |
| 3,363,548 | 1/1968 | Ajima | 101/333 X |
| 3,388,662 | 6/1968 | Raureby | 101/333 X |
| 3,661,078 | 5/1972 | Hammel | 101/405 X |
| 3,678,848 | 7/1972 | Roser et al. | 101/327 X |
| 3,759,180 | 9/1973 | Gibbons et al. | 101/405 |
| 3,885,495 | 5/1975 | Funahashi | 101/327 |

*Primary Examiner*—Edgar S. Burr
*Assistant Examiner*—Paul J. Hirsch
*Attorney, Agent, or Firm*—Geoffrey R. Myers

[57] ABSTRACT

A hand grip unit for rubber stamps comprising a substantially hollow hand grip area, a membrane extending across the lower opening of the hollow and having extending therefrom a stud member to be inserted into the rubber stamp, and stop means preventing the upper surface of the rubber stamp from contacting the lower surface of the hand grip portion. The membrane is sufficiently thin to allow the hand grip to flexibly pivot with respect to the rubber stamp, insuring the reproduction of a full, non-smudged image on the printing medium.

13 Claims, 4 Drawing Figures

FIG. 1.
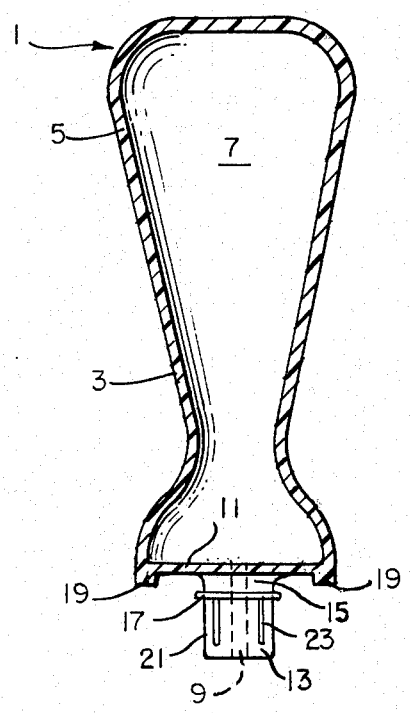
FIG. 3.
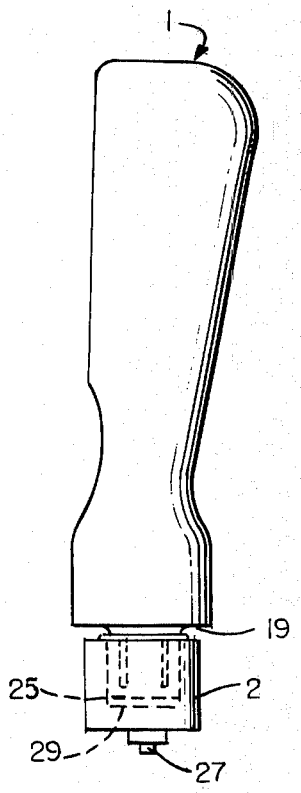
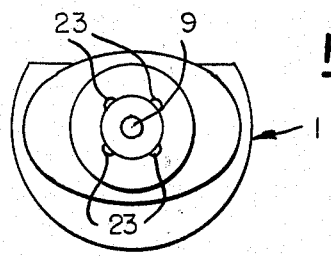
FIG. 2.
FIG. 4.
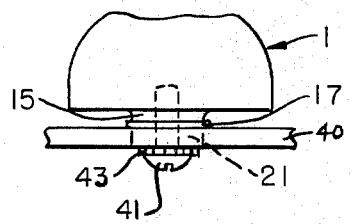

HAND GRIP UNIT FOR RUBBER STAMPS

This application relates to hand grips for printing stamps. More particularly, this application relates to a pressure equalizing hand grip for printing stamps commonly known in the art as "rubber stamps".

The problem of having to present a stamp to a printing medium directly perpendicular thereto in order to obtain a full print of the matter intended upon the printed medium, has been long known to the art. Solutions, particularly in the rubber stamp art, have generally revolved about locating a device somewhere between the rubber stamp printed portion and the hand grip, which allows the hand grip to flex or bend relative to the stamp, thus providing in the ultimate stamping operation a full print of the material on the stamp regardless of the angle at which the stamper presents the stamp medium to the printing medium.

This technique has been referred to, at times, in the art as "equalizing pressure" along the face of the stamp when it is brought into contact with the printing medium. Generally speaking, the aim of the prior art in rendering the grip flexible with respect to the stamp portion (i.e., the die), was to enable the die to assume a plane parallel to the printing medium surface and thus result in the imprinting of the whole of the die in an unblurred and complete impression fashion upon the printing medium, even if the stamp was not presented directly perpendicular, initially, to the printing medium.

The solution of built-in flexibility between the stamp and hand grip is a good one and works well for its intended purpose. Unfortunately, the specific devices proposed to effect this function or solution have generally been complex, difficult to manufacture, and result in a relatively expensive piece of equipment often not justifiable in the marketplace.

It is, therefore, apparent there exists a need in the art for a hand grip mechanism which, when used in conjunction with a stamp die or medium, will overcome the above-described printing problem in the art, and which will simultaneously be simple, easily manufactured, and economically justified in the industry.

It is a purpose of this invention to fill the above-described need in the art, as well as other needs which will become apparent to the skilled artisan once given the following disclosure, wherein:

IN THE DRAWINGS

FIG. 1 is a side plan partially sectionalized view of the embodiment of this invention;

FIG. 2 is a bottom plan view of the embodiment of FIG. 1;

FIG. 3 is a side plan view of the hand grip of FIG. 1 inserted into a typically conventional rubber stamp; and FIG. 4 is a side plan partial view of an embodiment of this invention.

Referring to the drawings, there is illustrated a substantially hollow hand grip unit generally designated as 1 useful for insertion into a conventional rubber stamp, such as rubber stamp 2 illustrated in FIG. 3. Hand grip 1 comprises a substantially hollow hand grip or hand held portion 3 defined by walls 5 and hollow portion 7. Hollow portion 7 is closed except for blow pinhole 9 (hereinafter more fully explained) by relatively thin membrane 11 extending across the lower surface thereof.

As can be seen best in FIG. 1, membrane 11, in the preferred embodiments of this invention, is of a lesser thickness than walls 5. While membrane 11 could be the same thickness as walls 5, and would be operative for the purposes intended herein, it is preferred to have membrane 11 somewhat thinner than walls 5 in order to maximize the flexing ability of membrane 11 while maintaining the rigidity of walls 5.

Extending from the lower surface of membrane 11 is stud 13 used as the connecting member between hand grip 1 and rubber stamp 2. Stud 13 is comprised of an upper portion 15 which connects the membrane 11 to stud 13, a stop ring 17 of sufficient diameter, and located sufficiently low on stud 13 to prevent, as shown best in FIG. 3, rubber stamp 2 from contacting the lower surface 19 of hand grip 1.

Also presented on the lower portion 21 of stud 13 are four fins 23 extending longitudinally and radially from the outer surface of stud 13. The purpose of these fins is to aid in the insertion of lower portion 21 into stamp 2 and to better secure, after a brief twist, lower portion 21 into stamp 2 regardless of the crudeness with which orifice 25 in stamp 2 has been formed.

Hand grip 1 may be made of any conventional material and need only be hollow a sufficient distance above the upper surface of membrane 11 to allow membrane 11 to flex. In the preferred embodiments of this invention, however, hand grip 1 obtains its most economic appeal by being formed in a unitary (one piece) structure and is made of a flexible plastic, such as polyethelene, via the conventional blow-molding technique.

Thus, in FIGS. 1–2, blow pinhole 9 as shown in its most convenient location. While blow pinhole 9 may be formed in any other location convenient for the blow-molding technique, it is preferred to locate it as an orifice extending through stud 13 and membrane 11, thus to form an escape mechanism for entrapped air when hand grip 1 is inserted into orifice 25 of stamp 2.

By making walls 5 of sufficient thickness via the blow-molding technique, e.g., approximately 1/16 of an inch, and by providing a small inset (by an inset in the blow-mold) so as to form membrane 11 of a slightly lesser thickness than walls 5, a readily flexible connecting member unitarily constructed within the device is provided. This, in turn, allows hand grip 1 to flexibly pivot with respect to stamp 2 during the stamping operation regardless of the initial angle at which the printing die portion 27 of stamp 2 is presented to the printing medium. In other words, hand grip 1 can flex, at an angle with respect to stamp 2 and die 27, thereby insuring a full, unsmudged impression of die 27 upon the printing medium.

By providing a blow-molded single piece structure, a simple, inexpensive hand grip is provided which is easily insertable into a rubber stamp. By providing, as a preferred option, fins 23, grip 1 may be rotated after insertion into orifice 25 thereby to insure a good hold between stamp 2 and grip 1. Fins 23 also and in combination with orifice 9 make grip 1 more easily insertable into orifice 25 by allowing entrapped air to escape during the inserting process.

In this respect, it is important to point out that typical "rubber stamps" are formed inexpensively using wood or plastic molding. Orifice 25 is then quickly drilled into the wood in the manufacturing process. Unfortunately, orifice 25 is not always of a uniform shape or size, thus presenting a problem to obtaining a good, secure fit between lower portion 21 of grip 1 and the walls of orifice 25, unless fins, which may be generally flexible despite their relatively small size, are provided.

Once given the above disclosure, many other features, modifications and improvements will become apparent to the skilled artisan. For example, while a stop mechanism should be presented in order to prevent the upper surface of stamp 2 from contacting lower surface 19 of hand grip 1 (which would otherwise inhibit the flexing of hand grip 1 with respect to stamp 2), it need not necessarily be done by way of stop ring 17. Other mechanisms could be employed. For example, stud 13 could be made long enough so as to bottom out on the bottom surface 29 of orifice 25 before surface 19 comes into the upper surface of stamp 2, or in another instance upper portion 15 could be made larger than lower portion 21 so as to provide a "shelf" that would act as a stop mechanism.

In another modification possible under this invention, and with reference to FIG. 4, the connecting mechanism between stamp 2 and hand grip 1 need not be by way of the insertion of a stud into a closed orifice in stamp 2. Rather, lower portion 21 could be inserted through an open orifice in the frame 40 of a conventional rubber stamp dater (i.e., such as where the stamp is of a conventional metal plate design) and connected by using a screw 41 (with toothed washer 43) inserted into blow pin hole 9. In such an instance, lower portion 21 is usually of a length slightly less than the thickness of frame 40. Means other than a threaded screw such as a snap ring could also be employed.

These other modifications are considered a part of this invention, the scope of which is to be determined by the following claims.

I claim:

1. A hand grip unit for a stamp comprising a connecting means and a rigid handle portion defined by a hollow portion including a closure for said hollow portion, said closure comprising a flexible membrane being a one piece continium of the handle portion and extending across said closure, said flexible membrane having extending therefrom said connecting means which comprises a connecting stud for connecting the unit to a stamp medium, and means for preventing the handle portion from contacting said stamp, when said handle is connected to said stamp, said flexible membrane being sufficiently flexible to allow said handle portion to flexibly pivot with respect to said stamp during the stamping operation.

2. A hand grip unit according to claim 1 wherein said means for preventing the handle portion from contacting the stamp includes a stop ring associated with said stud.

3. A hand grip unit according to claim 1 wherein said stud includes longitudinally and radially extending fins on at least a portion of its outer surface.

4. A hand grip unit according to claim 1, said unit being of a single piece.

5. A hand grip unit according to claim 4 wherein said hand grip unit is a blow-molded single piece of plastic.

6. In a stamp of the rubber stamp type comprising a rubber stamp including a printing die, and a hand grip unit including a means for connecting the hand grip unit to the stamp, the improvement comprising as said hand grip unit a hand grip unit comprising a connecting means and a rigid handle portion defined by a hollow portion including a closure for said hollow portion, said closure comprising a flexible membrane being a one piece continium of the handle portion and extending across said closure, said flexible membrane having extending therefrom said connecting means which comprises a connecting stud for connecting the unit to a stamp medium, and means for preventing the handle portion from contacting said stamp, when said handle is connected to said stamp, said flexible membrane being sufficiently flexible to allow said handle portion to flexibly pivot with respect to said stamp during the stamping operation.

7. A stamp according to claim 6 wherein said means for preventing the handle portion from contacting the stamp includes a stop ring associated with said stud.

8. A stamp according to claim 6 wherein said stud includes longitudinally and radially extending fins on at least a portion of its outer surface.

9. A stamp according to claim 6, wherein said stamp includes a laterally extending relatively thin element for retaining the stamp die and for connecting the die to said hand grip unit, said hand grip unit being connected to said element via said stud extending through an orifice therein.

10. A stamp according to claim 9, wherein said hand grip is a blow-molded single piece of plastic.

11. A stamp according to claim 10 wherein there is a blow pin hole in a surface of the stud.

12. A stamp according to claim 11 wherein said blow pin hole extends longitudinally through said stud and is in communication with said hollow portion.

13. A hand grip unit according to claim 1 wherein said hand grip unit is a substantially hollow body, the walls of said body being thicker than the flexible membrane.

* * * * *